US008646305B2

(12) United States Patent
Townsend et al.

(10) Patent No.: US 8,646,305 B2
(45) Date of Patent: Feb. 11, 2014

(54) DUCT SMOKE DETECTION SYSTEM AND METHOD

(76) Inventors: Robert L. Townsend, Upper Arlington, OH (US); Paul Bolander, Galena, OH (US)

( * ) Notice: Subject to any disclaimer, the term of this patent is extended or adjusted under 35 U.S.C. 154(b) by 636 days.

(21) Appl. No.: 12/911,780

(22) Filed: Oct. 26, 2010

(65) Prior Publication Data

US 2011/0094294 A1 Apr. 28, 2011

Related U.S. Application Data

(60) Provisional application No. 61/254,817, filed on Oct. 26, 2009.

(51) Int. Cl.
*G08B 29/12* (2006.01)

(52) U.S. Cl.
USPC ..... 73/1.05; 73/1.06; 340/515

(58) Field of Classification Search
USPC ..... 73/1.02, 1.06, 1.61, 1.05; 340/514, 515, 340/628, 632
See application file for complete search history.

(56) References Cited

U.S. PATENT DOCUMENTS

| | | | | |
|---|---|---|---|---|
| 5,361,623 | A * | 11/1994 | Wantz | 73/1.05 |
| 5,844,148 | A * | 12/1998 | Klein et al. | 73/863.82 |
| 2004/0035179 | A1 * | 2/2004 | Koch | 73/1.05 |
| 2009/0308134 | A1 * | 12/2009 | Pepper | 73/1.06 |

* cited by examiner

*Primary Examiner* — Daniel S Larkin
(74) *Attorney, Agent, or Firm* — Mueller Law, LLC; Jerry K. Mueller, Jr.

(57) ABSTRACT

An assembly for testing of smoke detectors, installed to detect the presence of smoke in ductwork or through a smoke protected opening, and includes a plenum rated hose assembly having a duct end and a smoke end. The hose assembly smoke end is extendable to within the duct and is terminated with a nozzle directable at an inlet tube of a smoke detector associated with the duct, or to the detector protecting a smoke protected opening. A duct mounting plate is adapted to be sealingly installed to cover an aperture formed within the duct and to retain the hose assembly duct end. Smoke is directed into the hose smoke end. The smoke exits the hose through the nozzle and towards the inlet tube of the duct-mounted smoke detector, or towards the detector for a smoke protected opening, for testing of the smoke detector.

8 Claims, 5 Drawing Sheets

DUCT SMOKE DETECTION SYSTEM AND METHOD

CROSS-REFERENCE TO RELATED APPLICATIONS

This application claims benefit of provisional application Ser. No. 61/254,817, filed on Oct. 26, 2009.

STATEMENT REGARDING FEDERALLY SPONSORED RESEARCH

Not applicable.

BACKGROUND

The present disclosure relates to HVAC (heating ventilating air conditioning) installed duct smoke detectors and more particularly to their testing. Duct mounted smoke detectors are installed in particular locations to meet certain requirements of, for example, the Ohio Building Code, as embodied in the Ohio Mechanical Code or OMC:

1. Mounted on the return air handler ductwork for all air handlers which, individually or as part of a system, have a design capacity greater than 2000 cfm. Installed upstream of any filters, exhaust air connections, outdoor connections, or decontamination equipment and appliances. (OMC606.2.1);
2. Where return air risers serve two or more stories and serve any portion of a return air system having a design capacity greater than 15,000 cfm, duct mounted smoke detectors shall be installed in each story. Duct mounted smoke detectors shall be located upstream of the connection between the return air riser and any ducts or plenums. (OMC606.2.3);
3. Mounted within five foot of code required smoke dampers. (OMC607.2.1.1).

Smoke detectors are required by the National Fire Alarm Code, a published standard of the National Fire Protection Association, to be tested at time of installation and subsequently annually. The frequency of testing and the method of testing are described in Chapter 10 of the National Fire Alarm Code standard. Table 10.3.1 requires that duct detectors have a visible inspection performed semiannually, to insure that there are no changes that would affect equipment performance. Table 10.4.4 requires that a duct type smoke detector be tested or inspected to ensure that the device will sample the air stream. The test shall be made in accordance with the manufacturer's instructions.

All manufactures of duct mounted smoke detectors recommend that test smoke be generated and travel in the duct work to enter the air sampling tubes of the duct mounted smoke detector. All Ohio's certified building departments require that the duct-mounted smoke detectors be tested per the manufacturer's testing instructions. All newly constructed building's mechanical fire alarm tests, performed by the local certified building departments, require that smoke be placed in the air duct's air stream and that the test smoke set the duct mounted smoke detector into alarm.

Testing of duct-mounted smoke detectors located on the air handler supply ductwork is difficult. The diffusers and filters on the air handler stop air-born particulates; consequently large volumes of test smoke must be generated at the return air location to travel through the air handler for enough test smoke to reach the duct mounted smoke detectors on the supply ductwork. Multiple duct mounted smoke detectors on the supply side are very difficult to test because duct mounted smoke detectors located downstream of other duct mounted smoke detectors will sample the test smoke laden air and shut down the air handler and the test smoke does not reach the duct mounted smoke detector desired to be tested. Tests currently require coordinated efforts of multiple people to manually bypass previously tested detectors so that the test smoke will travel downstream to untested detectors. Because great quantities of test smoke is running through the duct work the duct mounted smoke detectors become dirty from the test smoke and need to be cleaned to stop alarming. The tests are scheduled during unoccupied building use times because the air handler systems of the building are not conditioning the air in the building properly because they are being shutdown and also because the test smoke used to test the duct mounted smoke detectors has traveled throughout the whole building.

It is to this problem that the present disclosure is addressed.

BRIEF SUMMARY

In order to conduct periodic tests verifying proper operation of smoke detectors mounted within HVAC ductwork (e.g., return air ducts), the disclosed test assembly is installed. Various embodiments of such test assembly can be conceived based on the disclosure set forth herein. Of importance is that "smoke" is introduced into the duct just upstream of the smoke detector to be tested. Convenience and ease of operation are achieved by use of a "hose" to introduce generated smoke into the duct. For present purposes, "smoke" or "generated smoke" comprehends the use of an aerosol, with or without a propellant, which is effective in actuating the smoke detector to be tested. Such smoke may be a can of artificial smoke, smoke from combustion, or any other smoke detector actuating aerosol. For present purposes also, a "smoke detector" in an HVAC duct to be tested comprehends not only a smoke detector mounted inside the HVAC duct, but also the presence of a smoke protected opening inside the HVAC duct that urges detected smoke to the smoke detector mounted outside of the HVAC duct.

One disclosed assembly includes an HVAC duct mounting plate, a plenum rated hose, and a ceiling access plate assembly. The HVCA duct mounting plate holds the plenum rated hose in flush-mount position in the side of the HVAC duct and may be sealed by taping the edges of the mounting plate to the duct using HVAC rated tape. A gasket also may be used. The ceiling access plate assembly includes a ceiling-mounting bracket to securely hold the assembly in flush-mounting relationship with the ceiling, an optional hose retention bracket, and an access plate assembly.

Alternatively, the smoke can be generated inside the HVAC duct, such as by using either a small diameter hose or rigid piping, to transfer a pressurized aerosolized smoke into the duct where a nozzle is mounted. This could be as simple as removing the nozzle on an existing Smoke Check aerosol tester spray can (Home Safeguard Industries LLC, Elk Grove, Ill.) and then 'plugging' the stem of the can into the hose/piping system. The can contents then would pressurize the hose/piping system and spray the smoke aerosol through a nozzle mounted at the end of the hose/piping inside the HVAC duct in front of the smoke detector being tested.

One method for testing HVAC duct mounted smoke alarms includes accessing the plenum rated hose via the ceiling access plate assembly. The plenum rated hose has an end adaptor assembly for introducing smoke into the hose. When air is flowing in a duct at or just under atmospheric pressure, the smoke is drawn up through the plenum rated hose and into the flowing air in the duct. When the duct is at a higher pressure, the smoke needs to be assisted, for example, with a carrier gas at higher pressure to travel the length of the hose into the duct. As the disclosed kit was installed upstream of the smoke detector to be tested, the smoke entering the duct now can enter the smoke detector for its activation and testing.

Advantages of the present invention include the ability to limit the amount of test smoke entering the duct. Another advantage is that testing of the ductwork mounted smoke detectors can be accomplished quickly, which means less labor and less temperature change in the building. A further advantage is that the testing is very simple, enabling building owners to test the smoke detectors themselves. These and other advantages will be apparent to those skilled in the art based on the disclosure set forth herein.

BRIEF DESCRIPTION OF THE DRAWINGS

For a fuller understanding of the nature and advantages of the present apparatus and method, reference should be had to the following detailed description taken in connection with the accompanying drawings, in which.

The drawings will be described in greater detail below.

DETAILED DESCRIPTION

Figure 1:
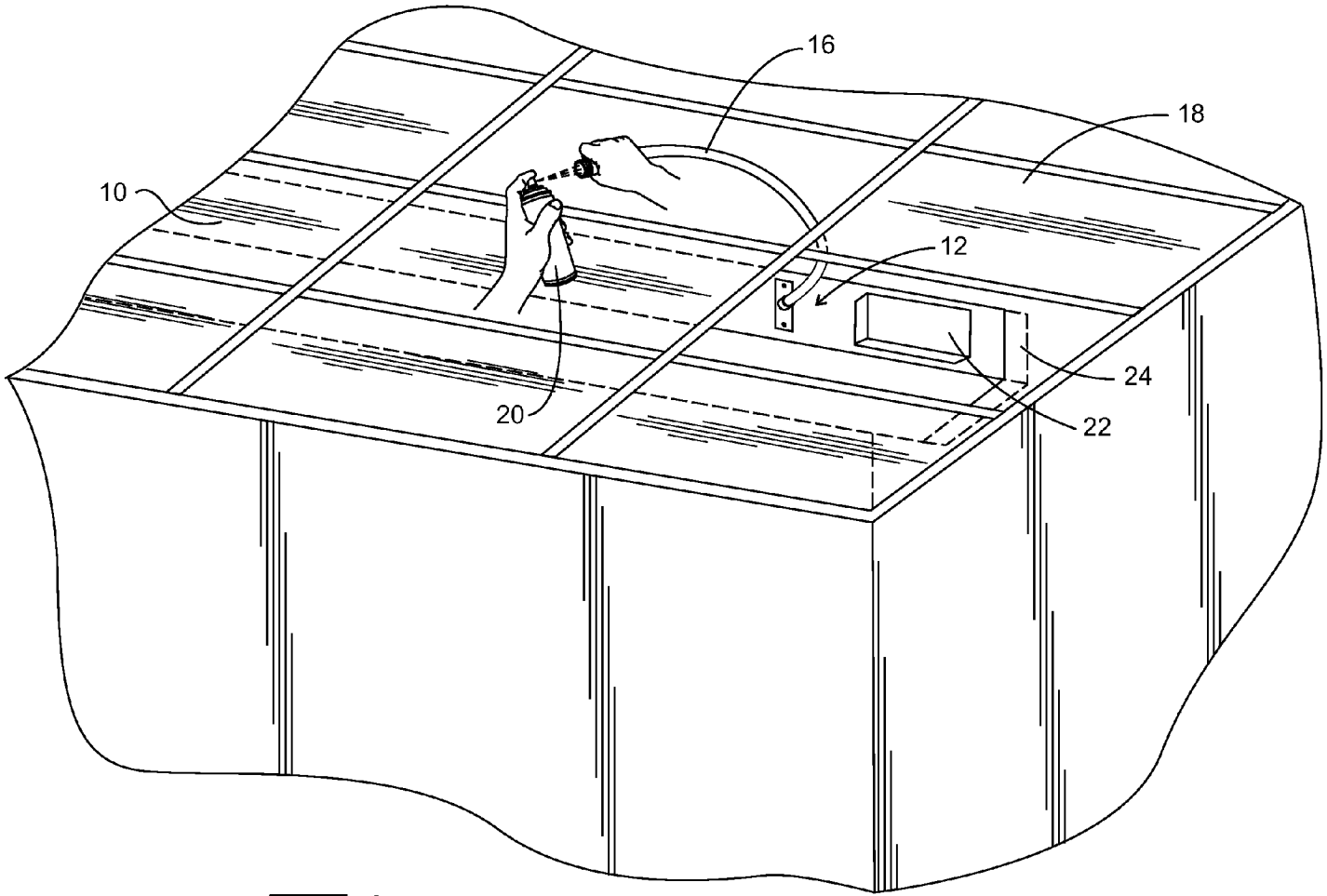
FIG. 1 is a perspective view of an above ceiling mounted duct having a smoke detector to be tested, the duct having the disclosed smoke detector assembly shown installed on the duct.

As illustrated in FIG. 1, a section of HVAC ductwork or duct, 10, has a ductwork mounting plate assembly, 12, affixed to duct 10 by screws and covering an aperture formed in duct 10. Each ductwork mounting plate assembly retains one end of a flexible, plenum rated, flexible hose, 16. For present purposes, "plenum rated" means that the hose meets all of the specifications and safety (e.g., fire) requirements that the ductwork meets according to applicable fire and other building codes and regulations. The other end of the hose terminates at the level of a ceiling, 18, below which ductwork 10 runs.

In this embodiment, flexible hose 16 just lies atop ceiling 18. Alternatively, hose 16 can be held by a clip attachment, which is part of a ceiling access plate assembly, as illustrated later herein. By removing a ceiling tile from ceiling 18, a can of smoke, 20, can be sprayed into an open end of hose 16 for introducing smoke into duct 10. Such smoke travels to a duct-mounted smoke detector, 22, for activating/testing smoke detector 22, which in turn closes a damper, 24, that prevents any contents in duct 10 from passing out of the room.

Figure 2:
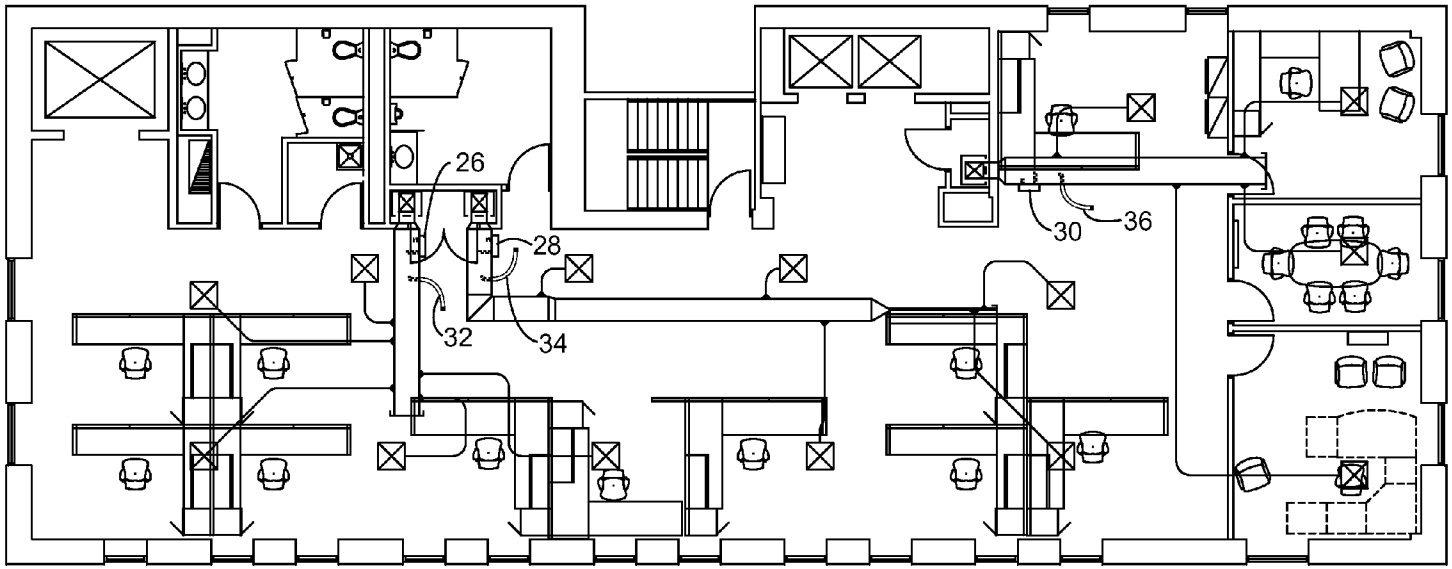
FIG. 2 is a floor plan of a typical office having several offices, meeting rooms, restrooms, hallways, and stairs, and showing various duct runs (ductwork) fitted with smoke detectors.

FIG. 2 shows a typical floor plan from a multi-floor building. In particular, there are three smoke detectors, 26, 28, and 30, located within the various ducts in the illustrated floor plan. Hoses, 32, 34, and 36, associated respectively with smoke detectors 26, 28, and 30, for admitting test smoke, are shown in close proximity to each of the noted smoke detectors.

Figure 3:
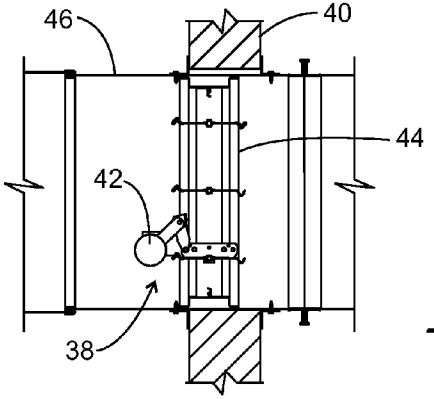
FIG. 3 is a sectional view through a wall whereat a duct damper is located.

FIG. 3 shows a damper assembly, 38, disposed within a wall, 40, of the floor plan of FIG. 2, which damper assembly is in association with one of the noted smoke detectors. In particular, when a smoke detector detects the presence of smoke, it actuates a motor assembly, 42, that closes a damper, 44, for stopping all airflow in a duct, 46. The smoke detectors each may be in communication with damper assembly 38 or with other damper assemblies (not shown) or with all damper assemblies associated with the floor plan of FIG. 2.

Figure 4:
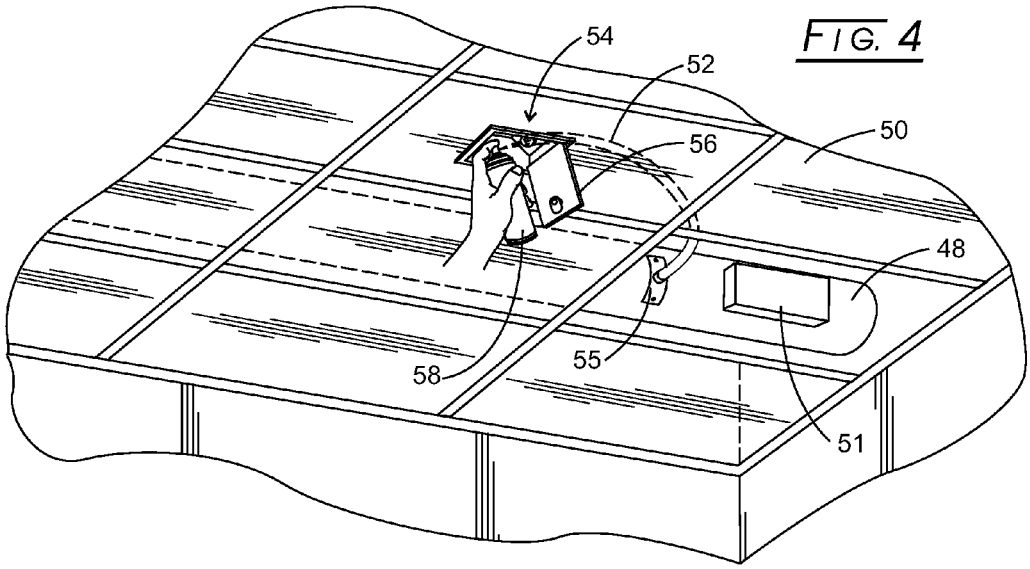
FIG. 4 is a perspective view showing a pressured can of smoke being sprayed into a hose accessed through a ceiling mounted opening, where the hose carries the smoke into a round duct.

Referring now to FIG. 4, a round duct, 48, is shown located above a ceiling, 50, and having a smoke detector, 51, located in association therewith. In this embodiment, a flexible test hose, 52, is affixed to round duct 48 with an apertured plate, 55, which is screwed into duct 48 to cover a hole in duct 48. The user accesses flexible hose 52 through an access plate assembly, 54, that has been installed in one of the ceiling tiles forming ceiling 50. Access plate assembly 54 can be simple or complex in construction. As illustrated in FIG. 4, access plate assembly 54 includes a frame installed in the ceiling tile and carrying a door, 56, that can be opened and shut by the user. The user can grasp flexible hose 52 after opening door 56 and then spray smoke from a smoke can, 58, into flexible hose 52 for testing smoke detector 50. Optionally, door 56 can have a lock for keeping unauthorized personnel from accessing flexible hose 52.

Figure 5:
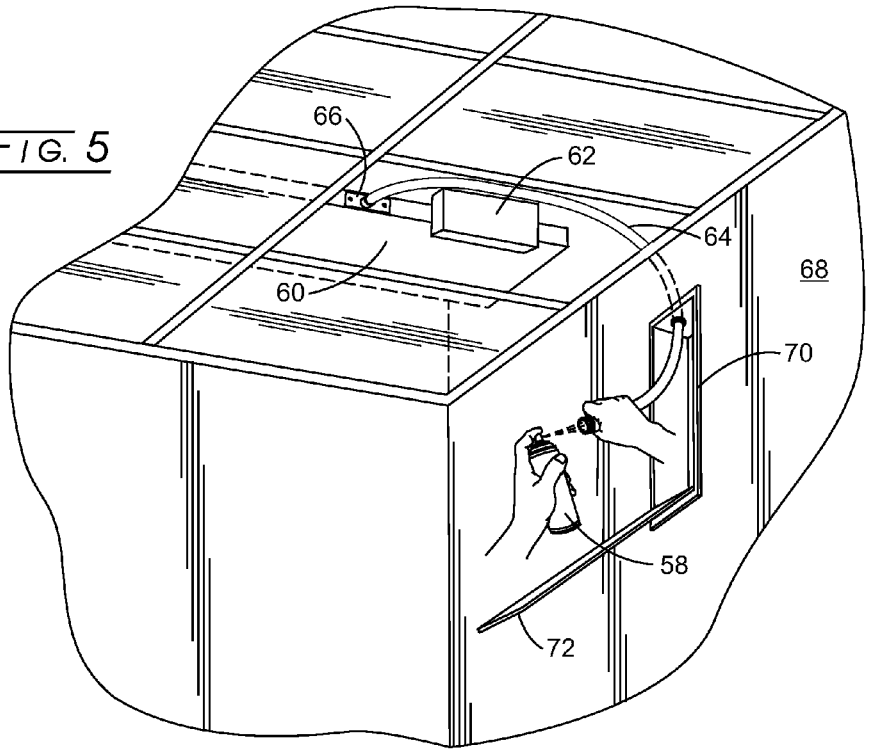
FIG. 5 is a perspective view showing a pressured can of smoke being sprayed into a hose accessed through a wall mounted opening, where the hose carries the smoke into a truncated rectangular duct.

In the embodiment illustrated in FIG. 5, a truncated, rectangular duct, 60, retains a smoke detector, 62. Again, a flexible test hose, 64, is affixed to duct 60 in the same manner as described in connection with FIG. 4. In this case, however, an access plate assembly, 66, is disposed horizontally due to the limited height of duct 60. Also, flexible hose, 64, runs down the interior of a wall, 68, and into an access box, 70, formed in wall 68. Again, a door, 72, covers access box 70 and similarly should be locked. The user can grasp flexible hose 62 after opening door 72 and then spray smoke from a smoke can, 58, into flexible hose 62 for testing smoke detector 50. Flexible hose 62 desirably will have no sharp turns or kinks in it that may retard the flow of smoke from can 58. Thus, hose 62 has only a gentle bend in it between access box 70 and duct 60. Similarly, the user should not unduly bend or kink hose 64 either.

Figure 6:
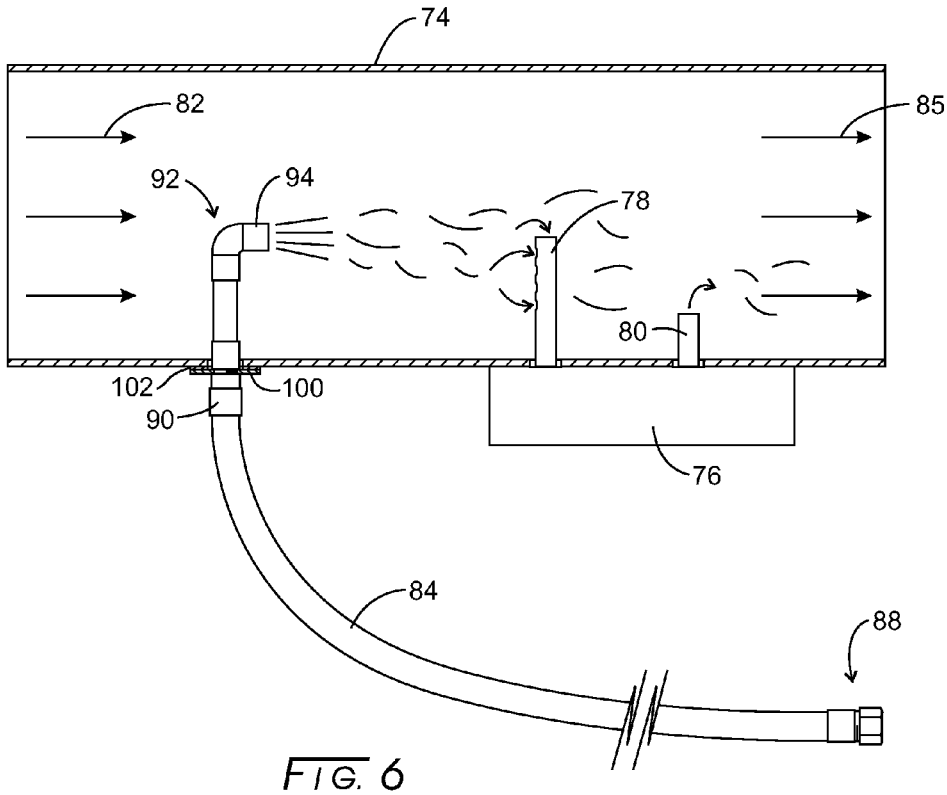
FIG. 6 is a cross-sectional view of a duct showing the smoke passing from the hose into the duct for testing a duct-mounted smoke detector.

Referring now to FIG. 6, a duct, 74, is shown in cross-section. A smoke detector, 76, is attached to duct 74 and has an inlet tube, 78, and a return tube, 80, extending to within duct 74. Large arrows, typified by arrows 82 and 85, show the direction of flow of air in duct 74. A flexible hose, 84, has a free end terminated by a coupling assembly, 88, which includes a removable cap and a captured end attached to a fitting, 90 that extends through an aperture formed in duct 74. Within duct 74, coupling 90 is attached to a nozzle assembly, 92, that may include one or more straight pieces, an elbow, and a nozzle fitting. The nozzle, 94, directs smoke directly at smoke detector inlet 78 to ensure that the test smoke reaches its desired target and to minimize the amount of test smoke required to test the operability of smoke detector 76. In this regard, the localized use of test smoke in close proximity to the smoke detector inlet tube and test smoke directed at the smoke detector inlet tube enables the present smoke test system to use a relatively small amount of test smoke and not set off remote smoke detectors not currently being tested. Such design also permits the offices to continue to be used with relatively little interruption during the testing procedure.

Figure 7:
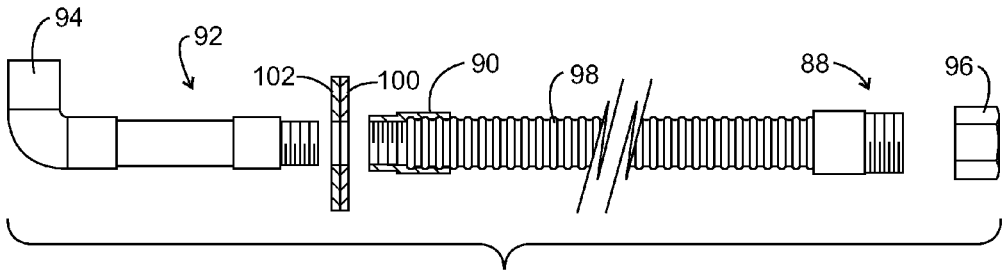
FIG. 7 is an exploded view of a hose used to carry the smoke into the duct.

Flexible hose 86 is shown in exploded view in FIG. 7. Coupling assembly 88 is seen to include a removable cap, 96, which closes the free end of hose 86 when not in use. The central section of hose 86 may be corrugated, such as corrugated hose section, 98, to ensure that hose 86 is not kinked or bent, which may prevent an adequate amount of test smoke from passing therethrough. A mounting plate, 100, and gasket, 102, are shown in greater detail in FIG. 7 and serve to establish an airtight connection of fitting 90 through the hole formed in duct 74. Alternatively, gasket 102 may be replaced by HVAC rated tape that is placed around the exterior of mounting plate 100. The various fittings and caps are threaded for screwing together; although, a variety of additional connection techniques can be readily envisioned by the skilled artisan.

Figure 8:
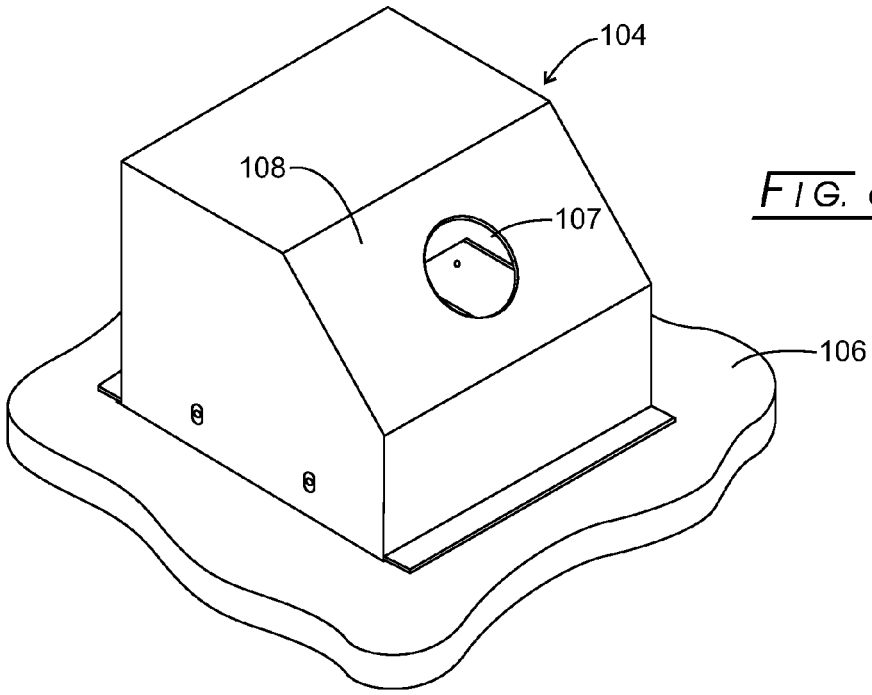
FIG. 8 is a perspective view of the HVAC ductwork mounting plate and a ceiling access plate assembly.
Figure 9:
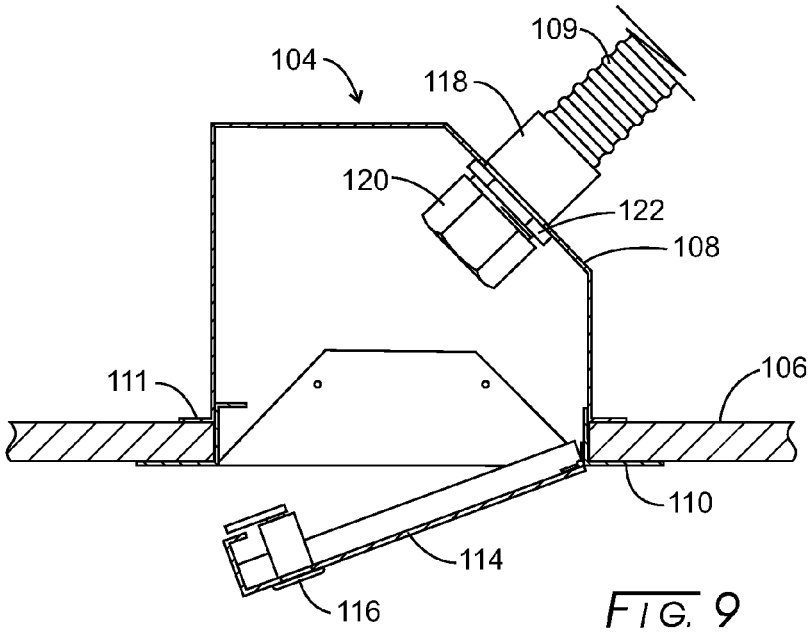
FIG. 9 is a cross-sectional view of the HVAC ductwork mounting plate and a ceiling access plate assembly of FIG. 8.

Referring now to FIGS. 8 and 9, an access box assembly, 104, is shown mounted atop a ceiling tile, 106. Access box assembly 104 has an aperture, 107, formed in a slanted side, 108, whose purpose will be revealed below. Access box assembly 104 has a pair of U-shaped brackets, 110 and 111, which fit around ceiling tile 106 in a rectangular opening that has been formed in ceiling tile 106. Access box assembly 104 also has a door, 114, for the user in the room below to open for accessing access box assembly 104. Access door 114 is fitted with a lock assembly, 116, to prevent unauthorized entry into access box assembly 104.

The free end of a flexible test hose, 109, has a fitting assembly, 118, that is placed in aperture 107 and a cap, 120 screwed into assembly 118 from the inside of access box assembly 104 to close off flexible hose 109 when not in use. A nut, 122 is screwed onto fitting assembly 118 from inside access box assembly 104 to retain hose 109 securely in place. Access box assembly 104 may be formed from aluminum, steel, or other appropriate material, which desirably is fire retardant.

In order to test a smoke detector using access box assembly 104, the user opens door 114, removes cap 120, and actuates a can of test smoke or other device 5 that generates test smoke. The test smoke is drawn up into hose 109 and then into a duct, as described before. Side 108 is slanted in order to ensure no sharp bends or kinks in hose 109, which may unduly retard the test smoke from easily flowing through hose 109. Side 108 is angled so as to ensure that hose 109 can be placed in a relatively straight line to the duct where the smoke detector to be tested is located. Alternatively, side 108 may not be slanted.

While the apparatus and method have been described with reference to various embodiments, those skilled in the art will understand that various changes may be made and equivalents may be substituted for elements thereof without departing from the scope and essence of the disclosure. Additionally, many modifications may be made to adapt a particular situation or material to the teachings of the disclosure without departing from the essential scope thereof. Therefore, it is intended that the disclosure may not be limited to the particular embodiments disclosed, but that the disclosure will include all embodiments falling within the scope of the appended claims. In this application the US measurement system is used, unless otherwise expressly indicated. Also, all citations referred to herein are expressly incorporated herein by reference.

We claim:

1. An assembly for testing of smoke detectors mounted within an air duct, which comprises:

(a) a plenum rated hose assembly having a duct end and a smoke end, wherein said hose assembly smoke end is extendable to and within said duct and is terminated with a nozzle directable at an inlet tube of a smoke detector associated with said duct; and (b) a duct mounting plate adapted to be sealingly installed to cover an aperture formed within said duct and to retain said hose assembly duct end.

2. The assembly of claim 1, wherein a removable cap is fitted over said smoke end of said hose assembly.

3. The assembly of claim 1, which further comprises:

(c) a ceiling access plate assembly adapted to hold said smoke end of said hose assembly and having a cover openable to access the smoke end of said hose assembly.

4. The assembly of claim 1, which further comprises:

(d) a wall mounted access plate assembly adapted to hold said smoke end of said hose assembly and having a cover openable to access the smoke end of said hose assembly.

5. The assembly of claim 1, which further comprises:

(e) an access box assembly mountable to a ceiling tile and having a slanted apertured wall to confront said duct mounting plate, said hose assembly smoke end being retained in the slanted wall aperture, said access box having an openable door to permit a user to direct smoke into said access box assembly and then into said hose assembly.

6. A method for testing smoke alarms mounted within a duct, which comprises the steps of:

(a) affixing the duct end of a plenum rated hose to a duct mounting plate installed over an aperture formed within a duct upstream of a smoke detector, wherein a hose assembly smoke end extends to and within said duct and is terminated with a nozzle directed at an inlet tube of said smoke detector associated with said duct, said hose also having a smoke end;

(b) activating a smoke source to introduce smoke to flow into said hose smoke end and thence into said duct to test said smoke detector.

7. The method of claim 6, wherein said smoke is drawn up through said hose and into said duct by reduced pressure present in said duct.

8. The method of claim 6, wherein a source of high pressure gas is introduced into said hose along with said smoke to cause said smoke to flow into said duct.

* * * * *